US006693382B2

(12) United States Patent
Little et al.

(10) Patent No.: US 6,693,382 B2
(45) Date of Patent: Feb. 17, 2004

(54) CONTROL SYSTEM FOR MICROWAVE POWERED ULTRAVIOLET LIGHT SOURCES

(75) Inventors: Richard Little, Hants (GB); David Briggs, Nr Reading (GB)

(73) Assignee: JenAct Limited, Hants (GB)

( * ) Notice: Subject to any disclaimer, the term of this patent is extended or adjusted under 35 U.S.C. 154(b) by 0 days.

(21) Appl. No.: 10/145,349

(22) Filed: May 13, 2002

(65) Prior Publication Data

US 2002/0171368 A1 Nov. 21, 2002

(30) Foreign Application Priority Data

May 17, 2001 (GB) ..... 0112031

(51) Int. Cl.[7] ..... H05B 41/36

(52) U.S. Cl. ..... 315/157; 315/248; 315/39; 250/504 R

(58) Field of Search ..... 315/39, 248, 344, 315/267, 149, 157, 158, 291; 313/567; 250/204 R, 432 R, 503.1

(56) References Cited

U.S. PATENT DOCUMENTS 4,103,175 A * 7/1978 Levin ..... 250/504 R
4,665,627 A * 5/1987 Wilde et al. ..... 315/149
4,683,379 A * 7/1987 Wolff ..... 250/493.1
5,040,236 A * 8/1991 Costello ..... 392/417
5,180,611 A * 1/1993 Costello ..... 427/96
5,434,419 A 7/1995 Decupper ..... 250/372
6,264,836 B1 * 7/2001 Lantis ..... 210/188
6,559,460 B1 * 5/2003 Keogh et al. ..... 250/492.1

* cited by examiner

*Primary Examiner*—James Clinger
*Assistant Examiner*—Ephrem Alemu
(74) *Attorney, Agent, or Firm*—Synnestvedt & Lechner LLP

(57) ABSTRACT

In microwave energized ultraviolet bulbs, much of the input energy is converted to heat emissions. It has been found that the efficiency of such a bulb can be optimized by monitoring power density of different portions of the UV spectrum (for example, UVA and UVC) and adjusting input power to the bulb and/or the bulbs temperature accordingly. This may be used not only to improve efficiency of the bulb but also to improve the efficiency of emissions at either UVA or UVC. A control system and suitable control parameters are described.

17 Claims, 3 Drawing Sheets

(M) = maximum low pressure UV output level

CONTROL SYSTEM FOR MICROWAVE POWERED ULTRAVIOLET LIGHT SOURCES

This invention relates to a control system for an ultraviolet light source, to a method of controlling a microwave energisable ultraviolet bulb and to apparatus for emitting ultraviolet radiation.

It is known that microwave-induced plasmas using a mixture of mercury mixed with elements such as iron, gallium, lead and in an inert gas, such as Ar, produce light, a large proportion of which is in the UV spectrum (320–445 nm).

Such a plasma may be contained in a transparent envelope which in practice is usually made from quartz. Striking of the plasma is made easier by evacuating the envelope and maintaining it at a lower pressure than atmospheric pressure (typically 10 mbar) prior to the plasma being struck. Once struck, energy is absorbed by the plasma and UV radiation is emitted via the UV-transparent quartz envelope.

Various methods of coupling the microwave energy to the plasma are known. For example, the bulb may be placed in a resonant cavity or be directly coupled to a microwave source using a transmission line such as a co-axial cable, or waveguide. Sometimes the addition of a tungsten or similar wire in the bulb envelope is used to aid striking.

Different UV lamp systems are currently available. Low power systems (typically up to 167 w/m rf input @ 20 mm envelope diameter) produce a "low pressure" spectral output, with peak output at UVC wavelengths (typically 254 nm). Medium pressure systems (typically 6.67 kw/m @ 20 mm dia) produce a "medium pressure" spectral output with peak output at UVA wavelengths (typically 365 nm).

Hitherto, it has usually been difficult to predict the power densities of different wavelengths of ultraviolet radiation from microwave energised bulbs based on the input power levels because of wide variations in RF coupling into the bulb and because of differing bulb dimensions. This is a significant problem in applications where particular portions of the UV spectrum (commonly designated UVA, UVB, UVC and UW) are desired to be emitted in particular power levels. For example in curing or germicidal applications, particular energy levels (often expressed as joules per square centimeter) of radiation need to be applied to an article. This has conventionally been carried out by making power measurements and then assuming that these measurements will hold good throughout the duration of bulb operation. With a known power level, the exposure or energy per unit area may be controlled by controlling the duration of exposure.

However a significant limitation of this approach is that in practice, the power output of the bulb varies over time.

In accordance with the invention there is provided a control system for an ultraviolet light source comprising a controller having spectral input means arranged to receive an input signal representative of the spectral power distribution of an ultraviolet light source, and control output means arranged to cause an adjustment in the energy input into the ultraviolet light source and/or to cause a change in the heat energy extracted from the ultraviolet light source responsive to the signal received at the spectral input means.

In another aspect of the invention there is provided a control a system of the type defined in the preceding paragraph in which the controller is arranged to cause a reduction in the energy input into the ultraviolet light source and/or to cause an increase in the heat energy extracted from the ultraviolet light source when the signal received at the spectral input means indicates a ratio of power in the UVC spectrum against the power of another predetermined portion of the UV spectrum or the whole of the UV spectrum which is below a predetermined threshold.

In a method aspect, the invention provides a method of controlling a microwave energised ultraviolet bulb comprising periodically measuring the spectral power density of the bulb output, deriving a measure of the power density in a first predetermined portion of the UV spectrum relative to the power density of a second predetermined portion of the UV spectrum which is overlapping or non-overlapping with the first portion, and controlling the bulb temperature by adjusting the RF output power of a microwave source coupled to the bulb and/or adjusting the thermal energy extracted from the bulb responsive to the derived measure, whereby the UV output of the bulb as a function of microwave energy input is optimised.

In a further apparatus aspect there is provided apparatus for emitting ultraviolet radiation comprising a source of microwave energy, a microwave energised ultraviolet bulb coupled to the microwave source, an ultraviolet transducer arranged to measure the spectral power density of ultraviolet light output by the bulb and a controller arranged to receive the output of the ultraviolet transducer, to analyse the power density of a first part of the output spectrum of the bulb relative to a second overlapping or non-overlapping of the part of the output spectrum of the bulb and to adjust the temperature of the bulb responsive to the relative power densities of the first and second portions of the bulb output spectrum.

As will be explained below, by monitoring the proportions, for example, of UVA and UVC emitted by a UV bulb, it is possible to operate the bulb atoptimum efficiency.

Embodiments of methods and control systems in accordance with the invention will now be described by way of example with reference to the drawings in which.

The Applicant has developed variable power supplies which permit variable power levels of microwave energy to be produced at 2.45 Ghz. These power supplies have an adjustable power range enabling variation from typical "low pressure" power intensities to "medium pressure" power intensities.

Using the variable power supplies, the Applicant has established that if a (say 150 mm×15 mm) mercury bulb is energised by microwave energy with the application of 30 watts rf power, a typical "low UV pressure" spectrum is emitted. If power is gradually increased to 1000 watts, the spectral output changes to a typical "medium pressure" UV spectrum.

It has been established by the Applicant that at "low pressure", more (typically 33%) of input energy is converted to UVC and that at "medium pressure", (typically 6–8%) of input energy is converted to UVC. UVC is necessary if using UV light in germicidal applications and thus in germicidal applications, maximising UVC output in relation to input power is desirable to maximise efficiency.

The Applicant has noted that the infrared heat emissions from medium pressure lamps are far higher than from low pressure lamps. For example the surface temperature of a 150 mm×15 mm bulb at 30 watts of rf power is approximately 60° C. whereas at the surface of the same bulb at 1000 watts of rf input power, it is approximately 500° C.+.

For many germicidal applications, such as disinfection of bottles, temperature control is important and thus it is desirable to minimise infrared emission as well as to maximise UVC emission.

The Applicant's research has shown that if the rf power input to a microwave powered UV lamp is increased gradually, there is not, as expected, a proportional change from low pressure characteristics to medium pressure characteristics. There is in fact a sudden change at a "threshold level". Once a certain "activation energy" is reached, pressure rises considerably and IR, visible light and UVA rise very quickly as UVC output falls quickly.

Figure 1:
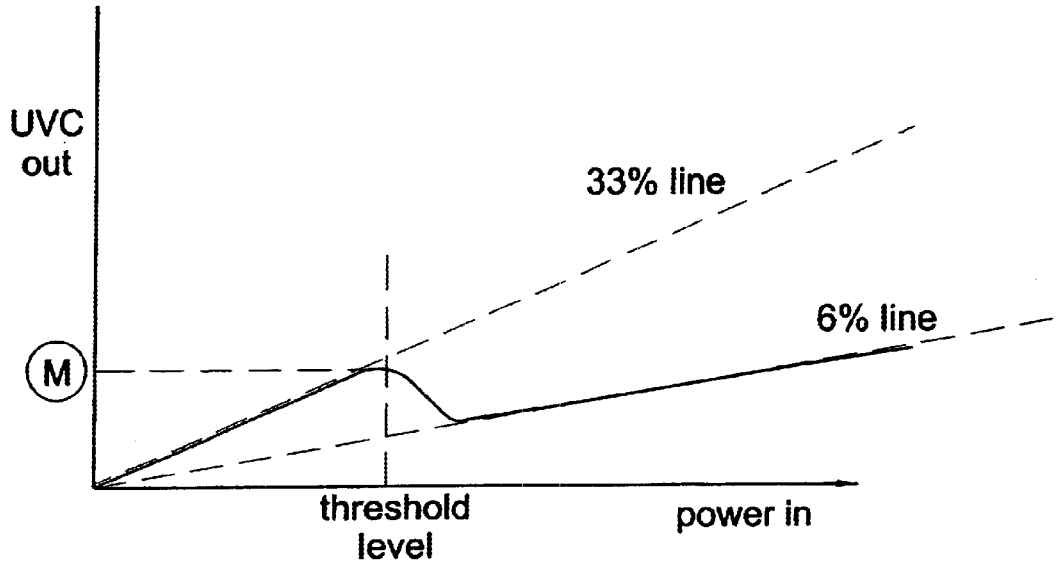
FIG. 1 is a plot showing UVC power out against rf power in for a typical mercury filled UV bulb.

Thus with reference to FIG. 1, there is a "knee" at a particular power input level at which the UVC output transfers from the line representing 33% of input power to the line representing 6% of input power. By operating the lamp at the left side of this "knee" efficiency of UVC output is maximised. Conversely, if it is desired to maximise output at other portions of the UV spectrum then the lamp is operated at higher power levels to the right of the "knee" in the Figure.

Figure 2:
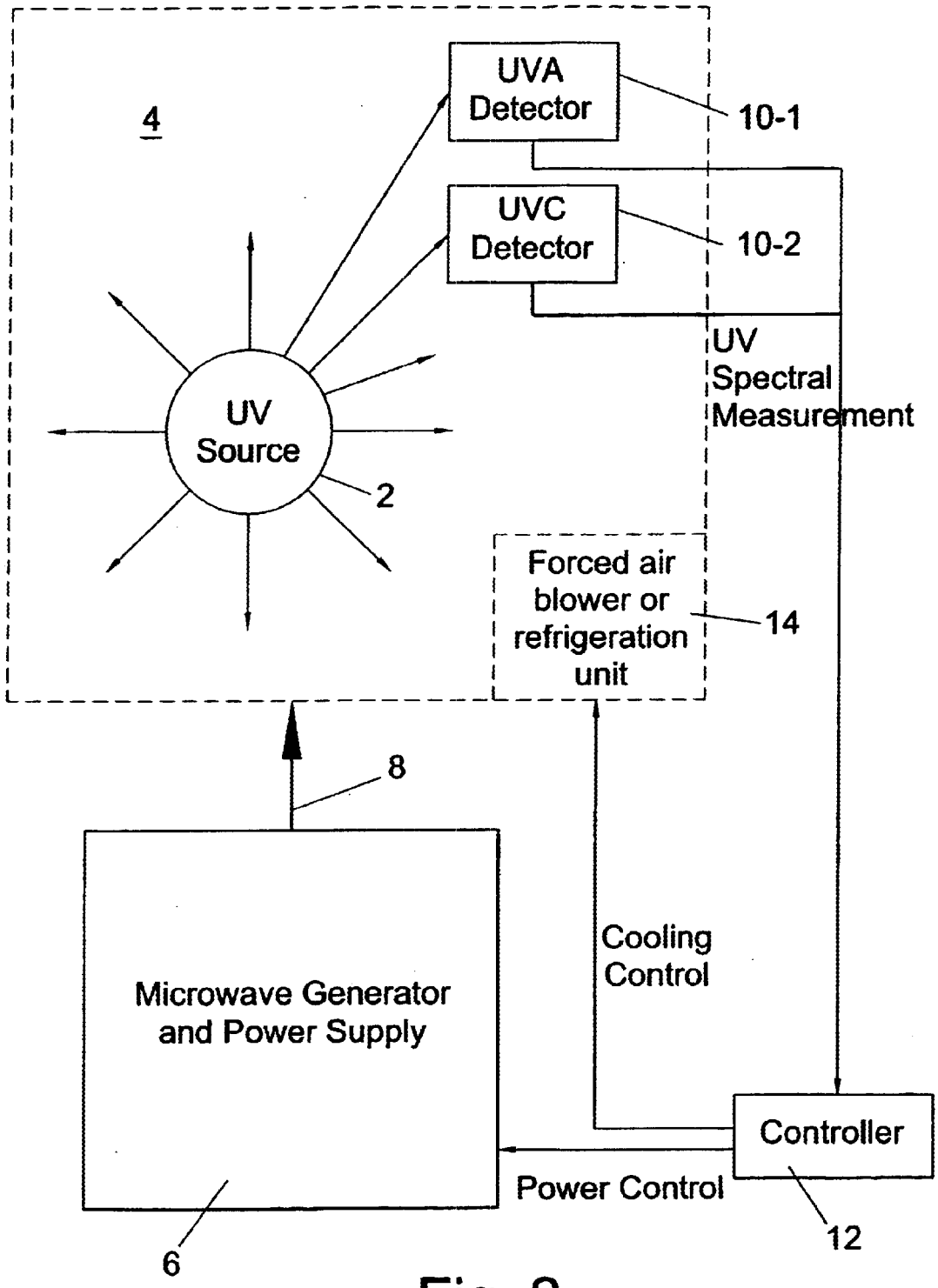
FIG. 2 is schematic block diagram of a control system in accordance with the invention.

Thus with reference to the schematic block diagram of FIG. 2, a UV source (typically a mercury filled quartz bulb) 2 is placed is a resonant microwave cavity 4. A microwave source such as a magnetron 6 is coupled to the resonant cavity 4 via a waveguide 8.

Alternatively, the microwave generator 6 may be directly coupled to the UV source 2 using a waveguide or a co-axial transmission line for example.

Detectors 10-1 and 10-2 are placed in line of sight of the UV source and are arranged to detect portions of the spectrum (typically UVA and UVC) which are emitted by the UV source. Their outputs (which are representative of power density) are fed into a controller 12.

The controller 12 is operable to monitor the relative magnitudes of the outputs of the detectors 10-1 and 10-2 and to provide control outputs responsive to those inputs.

Considering the graph of FIG. 1, it will be noted that one of the controllable variables to adjust the operating position of the bulb on the curve of the figure is the input power. Thus one possible control output is to vary the rf energy input to the bulb. This may be achieved, for example, using a variable current and/or voltage power supply for a magnetron in order to vary the rf output of the magnetron. Thus the outputs of the detectors 10-1 and 10-2 preferably form part of a feedback loop via the controller to the microwave generator and power supply 6. Thus if the detectors are configured, for example, to monitor the UVC and UVA portions of the spectrum, the ratio of UVA to UVC will generally be about 5 to 100% or less (i.e. proportionally more UVC) according to the Applicant's research, when the bulb is operating on the left side of the "knee" of the curve shown in FIG. 1. Thus in order to provide efficient UVC emission, the rf input power provided by the microwave generator 6 should be reduced when the proportion of UVC to UVA power detected by the detectors reduces below a threshold such as 4:1. The ratio of 4:1 seems to hold true for the bulbs tested but the invention is not limited to this ratio.

It will be understood by those skilled in the art that appropriate control systems techniques such as built-in hysteresis should be applied to the feedback loop to prevent unnecessary oscillations. However, the general principle of maintaining the proportion of UVC to UVA at or just below 4:1 does in this innovative arrangement, maximise the efficiency of UVC output relative to input power.

Conversely, if it is desired to maximise UVA output (for example in UV curing applications) then the rf input power is controlled to be increased until the proportion of UVC falls to approximately 6–8% of that of UVA. Since according to the Applicant's research, some of the reduction in UVC output is as a result of a spectral shift to UVA, it will be appreciated that UVA output is maximised by operating along the 6% line of the graph of FIG. 1. However, it has also been found by the Applicant that heat emissions are increased when operating in this region. Thus a further control schema may be to monitor infrared emissions in conjunction with UV emissions.

Figure 3:
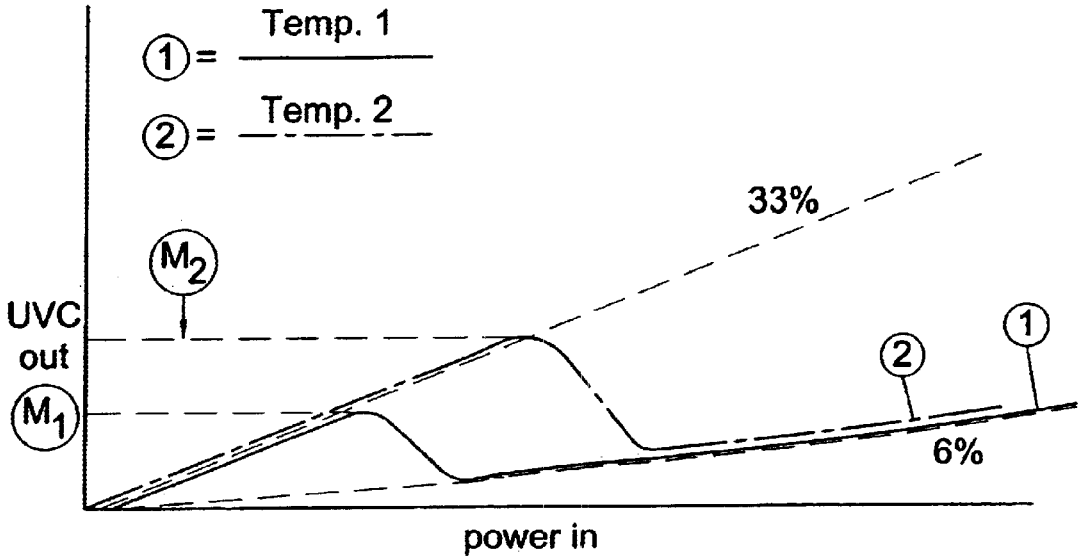
FIG. 3 is a plot showing the improvement produced by methods and apparatus in accordance with the invention.

It has also, surprisingly, been found by the Applicants that cooling of the bulb causes a shift in the position of the "knee". Thus with reference to FIG. 3, which shows two plots of UVC power out versus rf power in for two different bulb temperatures it will be noted that the maximum UVC power which may be produced by the bulb is increased.

Thus by providing increased cooling of the bulb (as denoted by the dotted line on the graph marked Temp.2) more power may be put into the bulb before the UVC output moves past the "knee" down on to the 6% line.

Therefore as a further control schema, the controller 12 may additionally or alternatively increase cooling of the bulb in response to a fall of the UVC output below the 4:1 proportion of UVA output. This may be achieved, for example, by using forced air cooling and/or refrigerated air. Alternatively, cooling may be reduced in order to optimise UVA output as discussed above.

Thus it will be appreciated that the problems of the prior art have been neatly removed using a self-adjusting feedback control loop. Efficiency is optimised and furthermore as a side effect, the temperature of the bulb can be controlled since as noted above, operation on the 33% line of the curve results in greatly reduced infrared emissions relative to operation on the 6% line.

Thus although the Applicant's research has shown that contrary to the expected result, increased input power into the bulb beyond a certain operating point, results in reduced output power in certain spectral bands, this unexpected result has been turned by the Applicant into an advantage since it provides a useful control threshold point for the Applicant's new feedback control apparatus.

Thus in summary, the Applicant's have through diligent efforts found that there are four variable factors in microwave energised ultraviolet bulbs which affect ultraviolet spectral output and output efficiency. These four factors are the initial fill pressure of the bulb, the volume of the bulb, the temperature of the bulb during operation and the power supplied and coupled into the bulb. Presently, such microwave energisable bulbs are produced using a rigid envelope of quartz. Thus the initial fill pressure and volume of the bulb are generally fixed after manufacture of the bulb. Thus the Applicant's invention concentrates on controlling the other two variables i.e. the temperature of the bulb and the power supplied and coupled into the bulb in response to a shift in the output spectrum. The threshold of UVC to UVA output power having a 4:1 value (as described above) is effective but may be varied. Furthermore, an absolute threshold of UVC or UVA, for example, may be used above rather than using a relative measurement such as UVA power relative to UVC power.

With further advances in bulb technology, it will be appreciated that if the other identified variables can be adjusted in operation then these also could be controlled by the controller 12.

It will be appreciated that cooling of the bulb may be carried out using forced air cooling or refrigeration as described above or using any other fluid such as water or gases other than air.

Suitable sensors for forming the detectors 10-1 and 10-2 are produced by EIT Inc., Virginia, USA such as their "compact sensor" range which are sold with filters to provide voltage outputs responsive to radiation in the UVA (320–390 nm) UVB (280320 nm), UVC (250–260 nm), and UW (395–445 nm) operational ranges. The controller 12 may for example be implemented using a micro-controller or a suitably equipped PC.

There now follows examples of applications of the invention.

EXAMPLE 1

UV bulb is rf energised and used to disinfect an air conditioning system or air duct where air flow is variable, or air temperature is variable (use, demand, climate etc.). Ducting forms rf resonant or non-resonant cavity and bulb is placed within cavity. Cavity also contains UVA and UVC sensors.

If UVA sensor registers more than ¼ of UVC reading, either power supply reduces chiller turns on to further cool air air flow is increased etc.

These actions can happen simultaneously or be prioritised and work sequentially.

EXAMPLE 2

In a packaging machine in an environment where internal factory temperature changes due to season or to other factors and lamp cooling is not possible, UV lamps will be turned on at reduced (say 20%) power and then power is increased until UVA rises to a maximum % of UVC. Power will than rise/fall to maintain this level.

Other Examples a) Water disinfection where water temperature varies.
b) UVC propagation or enhancement of chemical reaction where reaction temperature varies (possibly as a result of UVC activation.
c) UV curing reaction where 365 nm UVA output has to be maintained by high temperature (i.e. operate to right of "knee" in FIG. 1).

What is claimed is:

1. A control system for a microwave energiseable ultraviolet light source comprising a controller having spectral input means arranged to receive an input signal representative of the spectral power distribution of an ultraviolet light source, and control output means arranged to cause an adjustment in the energy input into the ultraviolet light source and/or to cause a change in the heat energy extracted from the ultraviolet light source responsive to the signal received at the spectral input means, wherein the controller is arranged to interpret an input signal which represents a ratio of the power of a predetermined portion of the UV spectrum against the power of another predetermined portion of the UV spectrum or the whole of the UV spectrum.

2. A control system according to claim 1, wherein the controller is arranged to interpret an input signal which represents the ratio of power in the UVC spectrum against the power of another predetermined portion of the UV spectrum or the whole of the UV spectrum.

3. Apparatus for emitting ultraviolet radiation comprising a source of microwave energy, a microwave energised ultraviolet bulb coupled to the microwave source, an ultraviolet transducer arranged to measure the spectral power density of ultraviolet light output by the bulb and a controller arranged to receive the output of the ultraviolet transducer, to analyse the power density of a first part of the output spectrum of the bulb relative to a second overlapping or non-overlapping part of the output spectrum of the bulb and to adjust the temperature of the bulb responsive to the relative power densities of the first and second portions of the bulb output spectrum.

4. Apparatus according to claim 3, wherein the temperature of the bulb is adjusted by adjusting the output power of the microwave source.

5. Apparatus according to claim 3, wherein the temperature of the bulb is adjusted by adjusting the thermal energy extracted from the bulb.

6. Apparatus according to claim 3, wherein the thermal energy extracted from the bulb is adjusted by adjusting the flow of a fluid such as air, past the bulb.

7. Apparatus according to claim 3, wherein the thermal energy extracted from the bulb is adjusted by adjusting the temperature of a fluid such as air, adjacent the bulb.

8. A control system for a microwave energiseable ultraviolet light source comprising a controller having spectral input means arranged to receive an input signal representative of the spectral power distribution of an ultraviolet light source, and control output means arranged to cause an adjustment in the energy input into the ultraviolet light source and/or to cause a change in the heat energy extracted from the ultraviolet light source responsive to the signal received at the spectral input means, wherein the controller is arranged to cause a reduction in the energy input into the ultraviolet light source and/or to cause an increase in the heat energy extracted from the ultraviolet light source when the signal received at the spectral input means indicates a rise or fall in the power of a predetermined portion of the UV spectrum above or below a predetermined power threshold.

9. A control system for a microwave energiseable ultraviolet light source comprising a controller having spectral input means arranged to receive an input signal representative of the spectral power distribution of an ultraviolet light source, and control output means arranged to cause an adjustment in the energy input into the ultraviolet light source and/or to cause a change in the heat energy extracted from the ultraviolet light source responsive to the signal received at the spectral input means wherein the controller is arranged to cause a reduction in the energy input into the ultraviolet light source and/or to cause an increase in the heat energy extracted from the ultraviolet light source when the signal received at the spectral input means indicates a ratio of power in the UVC spectrum against the power of another predetermined portion of the UV spectrum or the whole of the UV spectrum which is below a predetermined threshold.

10. A control system according to claim 9, wherein the predetermined threshold is in the range 5% to 30%, preferably in the range 10% to 27% and more preferably in the range 24% to 26%.

11. A method of optimising the efficiency of UVC emissions from a microwave energisable ultraviolet bulb comprising periodically measuring a proportion of UVC power emissions relative to the power of emissions in another overlapping or non-overlapping portion of the UV spectrum such as the UVA spectrum, and adjusting the temperature of and/or microwave power input to the bulb to maintain the proportion above or below a predetermined threshold value.

12. A method of controlling a microwave energiseable ultraviolet bulb comprising periodically measuring the spectral power density of the bulb output, deriving a measure of the power density in a first predetermined portion of the UV spectrum relative to the power density of a second predetermined portion of the UV spectrum which is overlapping or non-overlapping with the first portion, and controlling the bulb temperature by adjusting the RF output power of a microwave source coupled to the bulb and/or adjusting the thermal energy extracted from the bulb responsive to the derived measure, whereby the UV output of the bulb as a function of microwave energy input is optimised.

13. A method according to claim 12, wherein the first predetermined portion of the UV spectrum has wavelengths generally in the range 250 nm to 260 nm.

14. A method according to claim 12, wherein the derived measure is derived by calculating a ratio of the power density of the first and second predetermined portions.

15. A method according to claim 12 wherein the thermal energy extracted from the bulb is adjusted by adjusting the air flow around the bulb and/or adjusting the temperature of fluid, such as air, which is adjacent the bulb.

16. A method according to claim 12, wherein the second predetermined portion of the UV spectrum has wavelengths generally in the range 320 nm to 390 nm.

17. A method according to claim 16 wherein the bulb temperature is controlled by reducing the RF output power of a microwave source coupled to the bulb and/or increasing the thermal energy extracted from the bulb as the ratio decreases in value.

* * * * *